US006220434B1

(12) United States Patent
Kubota et al.

(10) Patent No.: US 6,220,434 B1
(45) Date of Patent: Apr. 24, 2001

(54) FASTENER ASSEMBLY

(75) Inventors: Mikio Kubota, Tokyo; Tadashi Suzuki, Saitama-ken, both of (JP)

(73) Assignee: Toska Co., Ltd., Tokyo (JP)

( * ) Notice: Subject to any disclaimer, the term of this patent is extended or adjusted under 35 U.S.C. 154(b) by 0 days.

(21) Appl. No.: 09/302,347

(22) Filed: Apr. 30, 1999

(51) Int. Cl.[7] ..... B65D 85/24; B65D 77/10; B65D 63/10

(52) U.S. Cl. ..... 206/343; 24/16 PB; 24/30.5; 24/711.1; 140/93.2; 292/318

(58) Field of Search ..... 292/318, 321, 292/322; 24/16 PB, 30.5 P, 711.1; 206/343, 345, 346; 140/93.2

(56) References Cited

U.S. PATENT DOCUMENTS 3,753,586 * 8/1973 Patterson ..... 24/16 PB
4,198,772 * 4/1980 Furutu ..... 297/318 X
4,429,437 * 2/1984 Paradis ..... 206/346
4,441,233 * 4/1984 Swift ..... 24/16 PB
4,456,123 * 6/1984 Russell ..... 206/343
4,495,972 * 1/1985 Walker ..... 140/93.2
4,534,464 * 8/1985 Lankton ..... 206/343
4,640,320 * 2/1987 Avison et al. ..... 24/16 PB X
4,901,854 * 2/1990 Bone et al. ..... 206/343
5,042,535 * 8/1991 Schlottke ..... 24/16 PB X
5,678,746 * 10/1997 Grendol ..... 24/711.1 X
5,799,375 * 9/1998 Fukami ..... 24/16 PB
5,908,110 * 6/1999 Hirai ..... 206/345
6,009,997 * 1/2000 Deschenes et al. ..... 206/346
6,041,925 * 3/2000 Grendol ..... 206/343

* cited by examiner

*Primary Examiner*—Bryon P. Gehman
(74) *Attorney, Agent, or Firm*—Arent Fox Kintner Plotkin & Kahn PLLC

(57) ABSTRACT

A fastener assembly which includes a plurality of fasteners each having a retaining projection which has a longitudinal axis, a fitting portion formed with an engaging hole which also has an axis in which the retaining projection can engage, and a filament portion arranged between the retaining projection and the fitting portion. A first joint member is connected with the retaining projections of the fasteners through first cutting portions each having a reduce sectional area. A second joint member is connected with the fitting portions through second cutting portions. In this manner, the fasteners are fixed to and securely supported by the first and second joint members to be arrayed in a plane. The axes of the retaining projections and the axes of the fitting holes of the fitting portions are formed perpendicular to the plane of the fasteners. An attaching device can be simply charged with the fastener assembly in a set and in an array and can be disassembled in the device into individual fasteners so that each of these fasteners is enabled to attach a price tag or label to a commodity with a loop of its filament portion by inserting its retaining projection easily to engage with the fitting portion. In the alternative, the fastener assembly can be manually used by disassembling it easily by hand into individual fasteners and can be held in the array state without any entanglement while it is being transported or stored.

2 Claims, 8 Drawing Sheets

FASTENER ASSEMBLY

BACKGROUND OF THE INVENTION

1. Field of the Invention

The present invention relates to a fastener of a synthetic resin to be used for attaching a price tag or label to a commodity while forming a loop of a filament shape or for bundling a plurality of commodities such as slippers, sandals or shoes into one set.

2. Description of the Prior Art

As a joint for attaching a price tag or label to a commodity such as clothes, there has been commonly used a retaining member of a synthetic resin, as called the "tag pin". This retaining member includes a thin, flexible filament portion, a cross bar portion formed perpendicularly on one end of the filament portion, and a flat, board-like head portion formed on the other end of the filament portion, such that it is wholly formed into a shape of letter "H".

Since this retaining member is far smaller than the price tag of the commodity, it is necessary to assemble a number of retaining members into one set so that they may be conveniently manufactured and handled. In order to hit the retaining members continuously by using a gun type attaching device, on the other hand, they have to be assembled into one set when the attaching device is to be charged with the remaining members at its feed groove. Therefore, the numerous retaining members are integrally molded of synthetic resin for use as an assembly on one joint rod through joint portions.

This retaining member assembly is formed into a fine molding having a comb shape in its entirety by jointing thirty five to one hundred and twenty retaining members on a connecting rod at the joint portions formed on an intermediate portion of a cross bar portion. This joint rod has a length of 80 to 160 mm, and a variety of sectional shapes such as a square, round or flattened round shape are adopted as the section of the joint rod by different makers.

When this retaining member is used to attach the price tag or the like to the commodity such as clothes, as well known in the art, a hollow needle, as mounted on the front portion of the attaching device, is driven to pierce to the back of the commodity while being inserted into the hole of the price tag or the like. After this, a lever, as elastically projected to the front of a grip portion of the attaching device, is squeezed to proceed a push rod in the attaching device to push the cross bar portion of the retaining member. Then, the cross bar portion is fed together with the filament portion, while cutting the joint portion, through the hollow needle to the back side of the commodity so that the price tag or the like is fixed on the commodity while clamping them between the cross bar portion on the back side and the head portion on the surface side.

However, this retaining member causes a problem that the commodity is holed because of piercing the hollow needle into the commodity to bring the cross bar portion to the back side of the commodity. Moreover, the application is restricted to such a thin commodity or clothes as can pass the hollow needle easily. Since the price tag is held by hooking the cross bar and the head portion in the hole, moreover, this hole is widened to damage the commodity if the price tag is pulled. Still moreover, regarding the retaining member, there is a limit that the retaining member can not be manually attached and the attaching device can not be dispensed with.

Because of the type in which the retention is made by the cross bar portion and the head portion, moreover, the retaining member is liable to pass through a relatively small hole such as the button hole of the commodity so that it cannot attach the price tag or the like to the button hole or the like of the commodity. On the other hand, the retaining member cannot be attached to the handle or the like of a bag because it is not of the type in which the retention is made by forming the loop.

On the other hand, there is the "string- or thread-shaped connecting member" in which a retaining projection (or male portion) is provided at one end of a flexible filament portion whereas a fitting portion (or female portion) for fitting the retaining projection to form the filament portion into a loop shape is formed at the other end. In this string-shaped connecting member, the retaining projection, the filament portion and the fitting portion are linearly arranged such that the axis of the retaining projection is formed in the extending direction of the filament portion whereas the axis of the fitting hole of the fitting portion, as formed to be inserted by the retaining projection, is perpendicular to the filament portion, and such that there is formed on the inner face of the fitting hole a retaining pawl with which the retaining projection is to engage.

This string-shaped connecting member is sold or used as a fastener or under the trade name of "LOX". This connecting member can simply form a closed loop by hands without any damage such as holing the commodity, so that it can be widely used for applications to attach the price tag or the like to the handle of a bag or to joint or bundle a plurality of commodities.

As the string-shaped connecting members are massively used in recent years, there has been developed a device for handling them automatically. It is considerably difficult to charge the device with the string-shaped connecting members of the prior art.

In the string-shaped connecting member of the prior art, more specifically, the retaining projection, the filament portion and the fitting portion are linearly arranged, and the axis of the retaining projection is formed in the extending direction of the filament portion whereas the axis of the fitting hole of the fitting portion, as formed to be inserted by the retaining projection, is formed perpendicular to the filament portion. In order to form the connecting member into the loop shape, therefore, the tip of the retaining projection has to be inserted into the hole of the fitting portion after the retaining projection is turned by 270 degrees to bring the retaining projection tip into a position to face the hole of the fitting portion. In short, in the automatic attaching device, when the fitting portion is gripped by one arm, the retaining projection cannot be fitted unless its direction is turned by the other arm.

When the price tag is to be attached to the handle of the bag, for example, more specifically, the fitting portion is gripped by one arm of the attaching device and is carried over the bag handle and to the back of the handle. Simultaneously with this, the retaining projection, having its filament portion inserted into the hole of the price tag, is turned by 270 degrees from the extension of the filament portion by the other arm and is then inserted below the handle and fitted in the fitting portion supported on the other side. These operations are manually simple, but when they are to be performed by the attaching device, the device is extremely complicated in its structure and is increased in its weight and size to raise a difficulty in the deteriorated operability. On the other hand, it is troublesome to charge the attaching device with the numerous string-shaped connecting members.

Therefore, we have manufactured an assembly of string-shaped connecting members in which a number of string-shaped connecting members are arrayed between two parallel joint rods to form a sheet shape as a whole. This assembly is excellent in its moldability, and the attaching device can be simply charged with the assembly. At the same time, the string-shaped connecting members may be separated for use one by one from the assembly so that the assembly is excellent in its handling quality. When the attaching device is to be charged with the assembly, on the other hand, there has been examined a method of bending the sheet-shaped array into a shape of letter "U". Therefore, we have developed a method of inserting and fitting the retaining projection simply into the hole of the fitting portion to joint the filament portion in the loop shape not by turning the retaining projection by 270 degrees with respect to the fitting portion supported by one arm but by merely moving the retaining projection forward with respect to the fitting portion.

BREEF SUMMARY OF THE INVENTION

According to the invention, there is provided a fastener assembly which comprises: a plurality of fasteners each including a retaining projection, a fitting portion for engaging with the retaining projection, and a filament portion arranged between the retaining projection and the fitting portion; a first joint member connecting with the retaining projections of the fasteners through first cutting portions; and a second joint member connecting with the fitting portions through second cutting portions, to array the fasteners in a sheet shape. The axes of the retaining projections and the axes of the fitting holes of the fitting portions are formed normal to the sheet-shaped array plane of the fasteners.

On the other hand, the retaining projections of the fasteners are jointed to each other through first temporary joint portions, and the fitting portions are jointed through second cutting portions by second joint member, to form the fastener assembly.

On the other hand, the retaining projections of the fasteners are jointed to each other through first temporary joint portions, and the fitting portions are jointed to each other through second temporary joint portions, to form the fastener assembly.

An attaching device can be simply charged with the aforementioned fastener assembly in a set and in an array and can be simply disassembled in the device into individual fasteners so that each of these fasteners is enabled to attach a price tag or label to a commodity with a loop of its filament portion by inserting and engaging its retaining projection easily with the fitting portion.

On the other hand, the fastener assembly can be manually used by disassembling it easily by hands into individual fasteners and can be held in the array state without any entanglement while it is being transported or stored.

Figure 1:
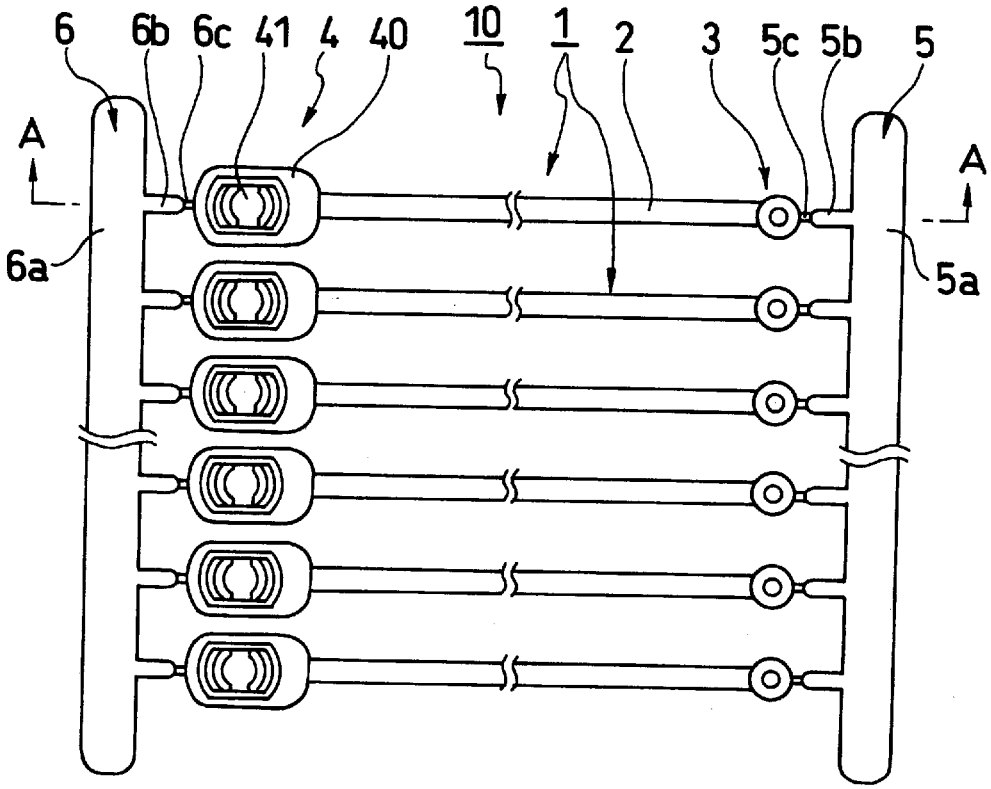
FIG. 1 is a top plan view showing a first embodiment of a fastener assembly according to the invention.

Embodiments of the invention will be described with reference to the accompanying drawings.

Description will be made at first on the fastener simple composing the fastener assembly of the invention, as shown in FIGS. 7 to 11, and then on the fastener assembly, as shown in FIGS. 1 to 6.

A fastener 1 is made, as shown in FIGS. 7 to 11, of a slender, flexible filament portion 2 having a retaining projection (or male portion) 3 at its one end side and a fitting portion (or female portion) 4 at its other end side.

This retaining protrusion 3 of the fastener 1 is formed of: a cylindrical trunk portion 30 connecting at its side portion with the filament portion 2; a neck portion 31 connecting with the trunk portion 30 but having a smaller diameter than that of the trunk portion 30; and a head portion 32 connecting with the neck portion 31 but having a larger diameter than that of the neck portion 31. The head portion 32 is formed at its tip into such a tapering conical or spherical shape as to be easily fitted in the fitting portion 4.

On the other hand, this fitting portion 4 is formed of a frame portion 40 having an engaging hole 42 therein, and a retaining portion 44 formed on one side of the frame portion 40 and having a radially smaller retaining hole 41 than the engaging hole 42, and is provided, in the retaining portion 44 on the side of the engaging hole 42, with a pair of retaining members 43 enclosing the retaining hole 41.

On the other hand, the individual axes of the retaining projection 3 and the engaging hole 42 of the fitting portion 4 are arranged perpendicularly to the filament portion 2 so as to facilitate the engaging operation by a later-described attaching device.

Figure 12:
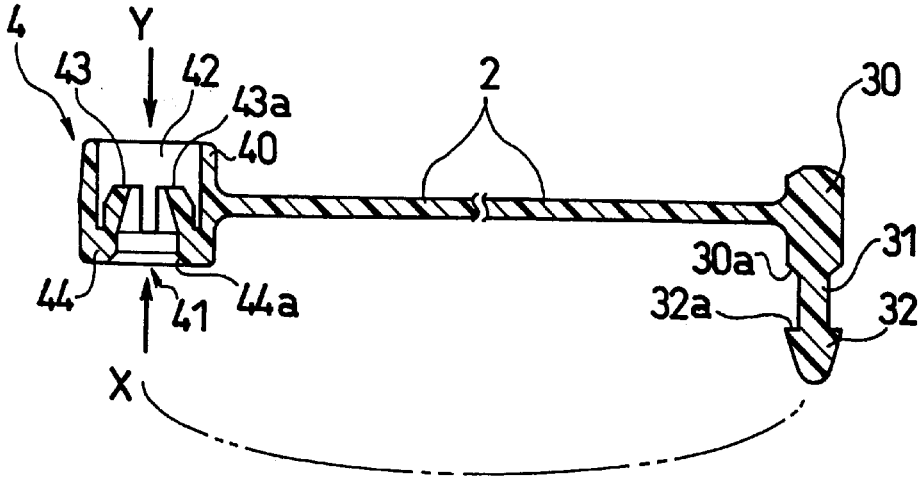
FIG. 12 is a section taken along line D—D of FIG. 8.
Figure 13:
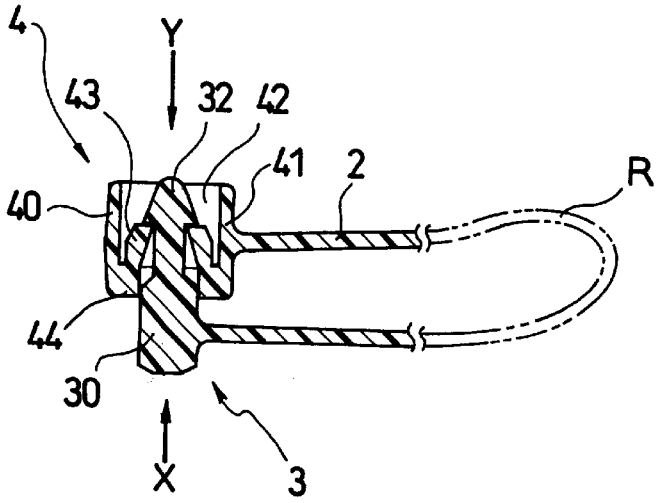
FIG. 13 is a section of a portion when a retaining projection and a fitting portion of the fastener of FIG. 7 are fitted.

As shown in FIG. 12 and FIG. 13, moreover, the head portion 32 of the retaining projection 3 is turned by 180 degrees from the extension of the filament portion 2 and is brought to face the retaining hole 41 of the fitting portion 4. When the head portion 32 is pushed to an inserting direction X, it is brought into the retaining hole 41 and protrudes into the engaging hole 42 while elastically deforming and opening the surrounding retaining members 43. In this case, the fitting portion 4 may be turned by 180 degrees, or alternatively the retaining projection 3 may be turned by 90 degrees and the fitting portion 4 may also be turned by 90 degrees. In short, when either the retaining projection 3 or the fitting portion 4 is turned totally by 180 degrees, the head portion 32 of the retaining projection 3 and the retaining hole 41 of the fitting portion 4 then come into the facing positions.

Now, when the head portion 32 protrudes from the retaining members 43, these retaining members 43 restore their elastic deformations to reduce their diameter so that their crest faces 43*a* of the retaining members 43 abut against a retaining face 32*a* of the head portion 32, as shown in FIG. 13, to prevent the head portion 32 from moving in a returning direction Y.

As a result, the retaining projection 3 and the fitting portion 4 can come into engagement to form a loop R of the filament portion 2.

The sizes of the ordinary fastener 1 will be exemplified in the following. The retaining projection 3 shown in FIG. 7 has a height H of 6.3 mm and a diameter R of 1.6 mm; the neck portion 31 has an external diameter of 0.9 mm; the filament portion 2 has the minimum diameter P of 0.3 to 0.5 mm; the frame portion 40 has a longer side L of 4.6 mm and a width of 2.8 mm; the retaining hole 41 has an internal diameter of 1.65 mm; and the retaining members 43 have an internal diameter of 1.1 mm. Moreover, the retaining projection 3 and the fitting portion 4 are formed at a spacing of 50 to 250 mm.

Figure 14:
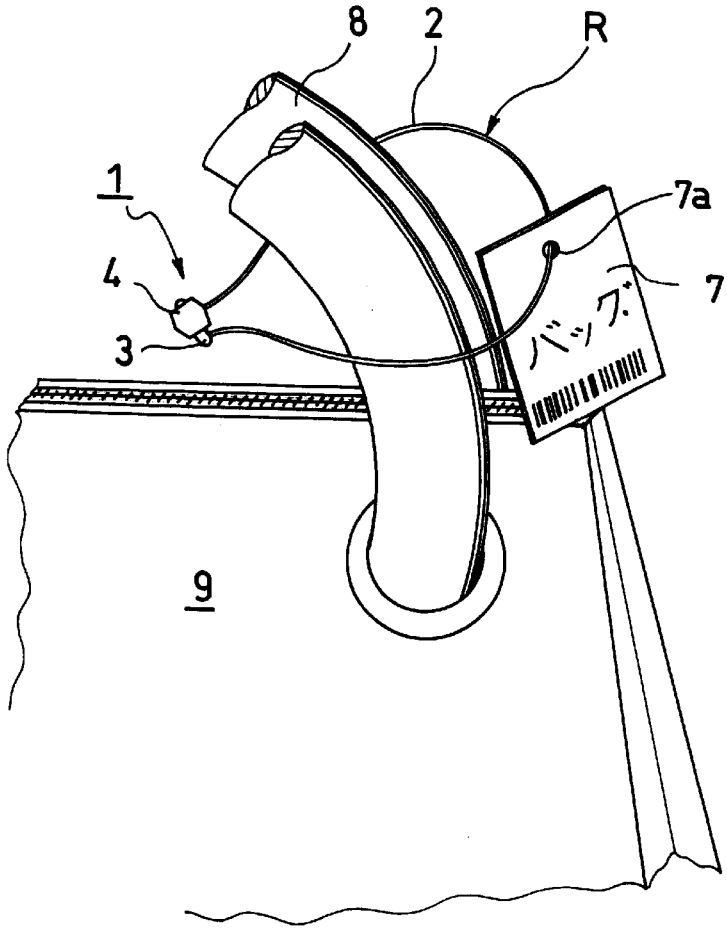
FIG. 14 is an explanatory view showing a used state of the fastener.

According to this fastener 1, as shown in FIG. 14, a price tag 7 can be attached to the handle 8 of a bag 9 by inserting the fastener 1 into the hole 7*a* of the price tag 7 and turning it around the handle 8, and by inserting and forcing the retaining projection 3 on one end side of the filament portion 2 of the fastener 1 into the fitting portion 4 on the other end side to bring the retaining projection 3 and the fitting portion 4 into engagement thereby to form the loop R of the filament portion 2 easily by this single action.

Likewise, the price tag 7 or the like can be easily attached to commodities such as clothes by forming the loop R of the filament portion 2 through button holes or the like of the clothes.

In a similar manner, a plurality of commodities can be easily bundled into one set by forming the loop R of the filament portion 2.

When these attaching operations of the fasteners 1 are to be performed by a gun type attaching device disclosed in Japanese Patent Application No. 9-209255, moreover, it is necessary to feed the fasteners 1 sequentially to the position to be hit. For this necessity, a number of fasteners 1 have to be formed into a series of fastener assembly 10, 10A or 10B.

This fastener assembly 10, 10A or 10B is integrally molded of a synthetic resin, as shown in FIGS. 1 to 6, by jointing the retaining projections 3 and the fitting portions 4, as forming the two ends of the fasteners 1, respectively, by a first joint member 5 and a second joint member 6 and so on.

Figure 2:
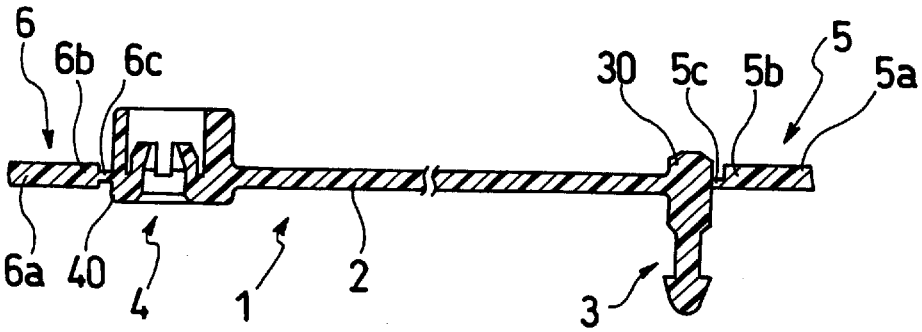
FIG. 2 is a section taken along line A—A of FIG. 1.

First of all, the fastener assembly 10 of a first embodiment, as shown in FIGS. 1 and 2, corresponds to the construction in which the filament portions 2 have a relatively large length or a relatively low rigidity. The first joint member 5 is formed of: a first joint rod 5*a* having a relatively large sectional area and a relatively high strength; first projections 5*b* projecting in the shape of comb teeth from the first joint rod 5*a*; and first cutting portions 5*c* leading from the first projections 5*b* to the trunk portions 30 of the retaining projections 3 and formed in the extending direction of the filament portions 2 while being reduced in their sections to be easily cut. The first joint member 5 thus formed is jointed to the retaining projections 3 on the side opposed to the filament portions 2.

Like the first joint member 5, on the other hand, the second joint member 6 is formed of: a second joint rod 6*a* having a relatively high rigidity; second projections 6*b* projecting in the shape of comb teeth from the second joint rod 6*a*; and second cutting portions 6*c* leading from the second projections 6*b* to the frame portions 40 of the fitting portions 4 and formed in the extending direction of the filament portions 2 while being reduced in their sections to be easily cut. The second joint member 6 thus formed is jointed to the fitting portions 4 on the side opposed to the filament portions 2.

In short, the fasteners 1 are supported and fixed at their two individual ends by the first joint rod 5*a* and the second joint rod 6*a* having relatively high rigidities through the first cutting portions 5*c* and the second cutting portions 6*c* which are easy to cut.

When the plurality of fasteners 1 are jointed by the first joint member 5 and the second joint member 6 to form the fastener assembly 10, moreover, they are arrayed in a sheet shape, and the axes of the retaining projections 3 and the axes of the engaging holes 42 of the fitting portions 4 are formed perpendicular to the sheet-shaped plane of the fasteners 1.

In this case, the first and second joint rods 5*a* and 6*a* or the joints of the fastener assembly 10 are provided at every ten and several to several tens of the fasteners 1 with portions of reduced sections such as V-shaped notches so that the fastener assembly 10 can be easily cut at those portions by hands or by using a cutter. This makes it possible to separate a unit of ten and several to several tens of fasteners thereby to charge the attaching device with each unit for the attaching operations.

Figure 15:
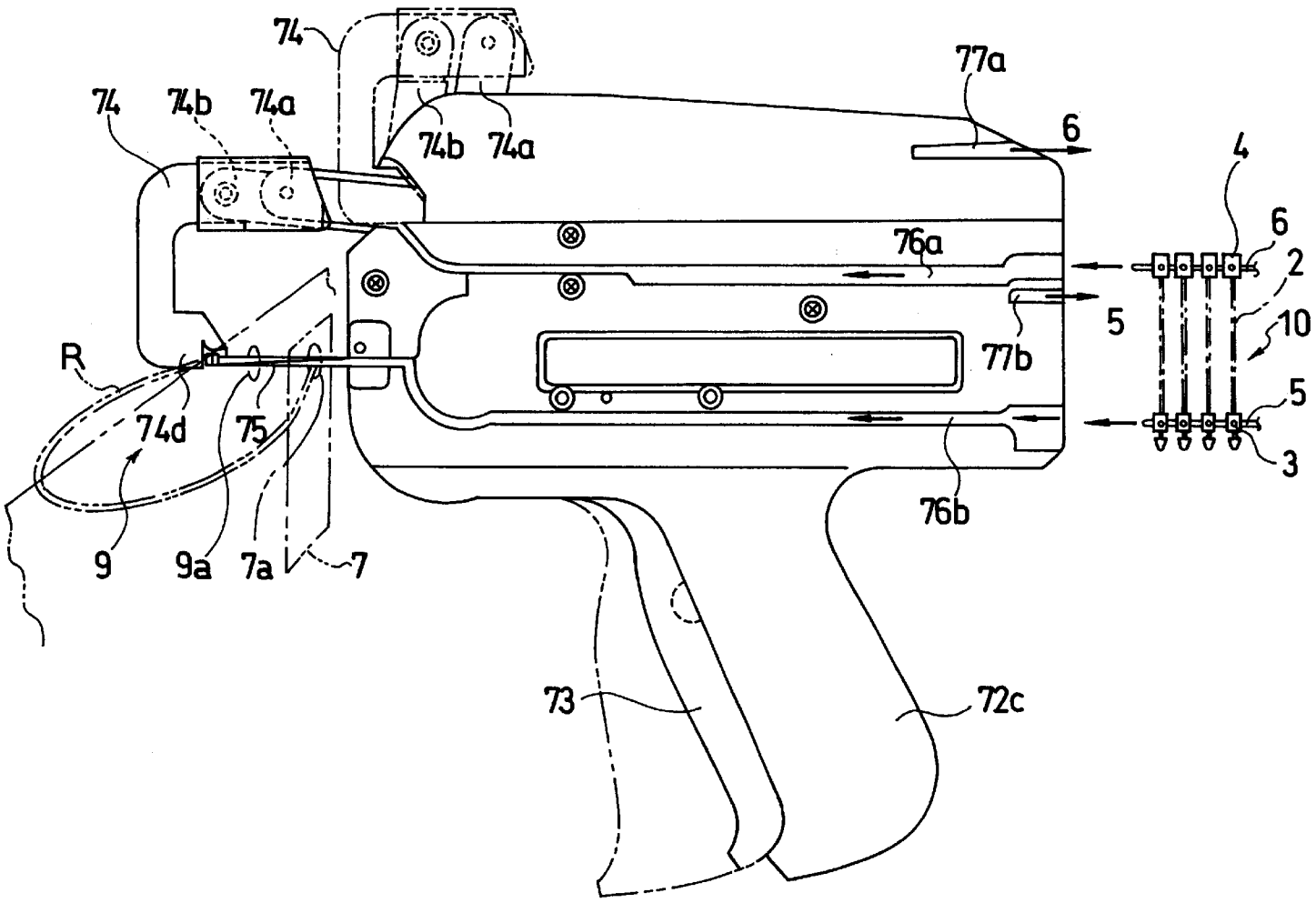
FIG. 15 is a righthand side elevation of a gun type attaching device charged with the fastener assembly.

When this fastener assembly 10 is to be used with the gun type attaching device of Japanese Patent Applacation No. 9-209255, for example, as presented on its righthand side in FIG. 15, this attaching device is charged with the fastener assembly 10 by inserting the retaining projections 3 of the fastener assembly 10 together with the first joint member into a charging portion 76*b*, as located on the righthand lower side, and by inserting the fitting portion 4 together with the second joint member into a charging portion 76*a*, as located at the righthand intermediate portion, and pushing them in direction of arrows. At this time, the retaining projections 3 and the fitting portions 4 are inserted into the charging portions 76*a* and 76*b* which are arranged vertically (above and below) in parallel with each other in the righthand side face of the attaching device, so that the filament portions 2 are arranged while being warped in the shape of letter "U" on the righthand face of the attaching device.

Figure 16:
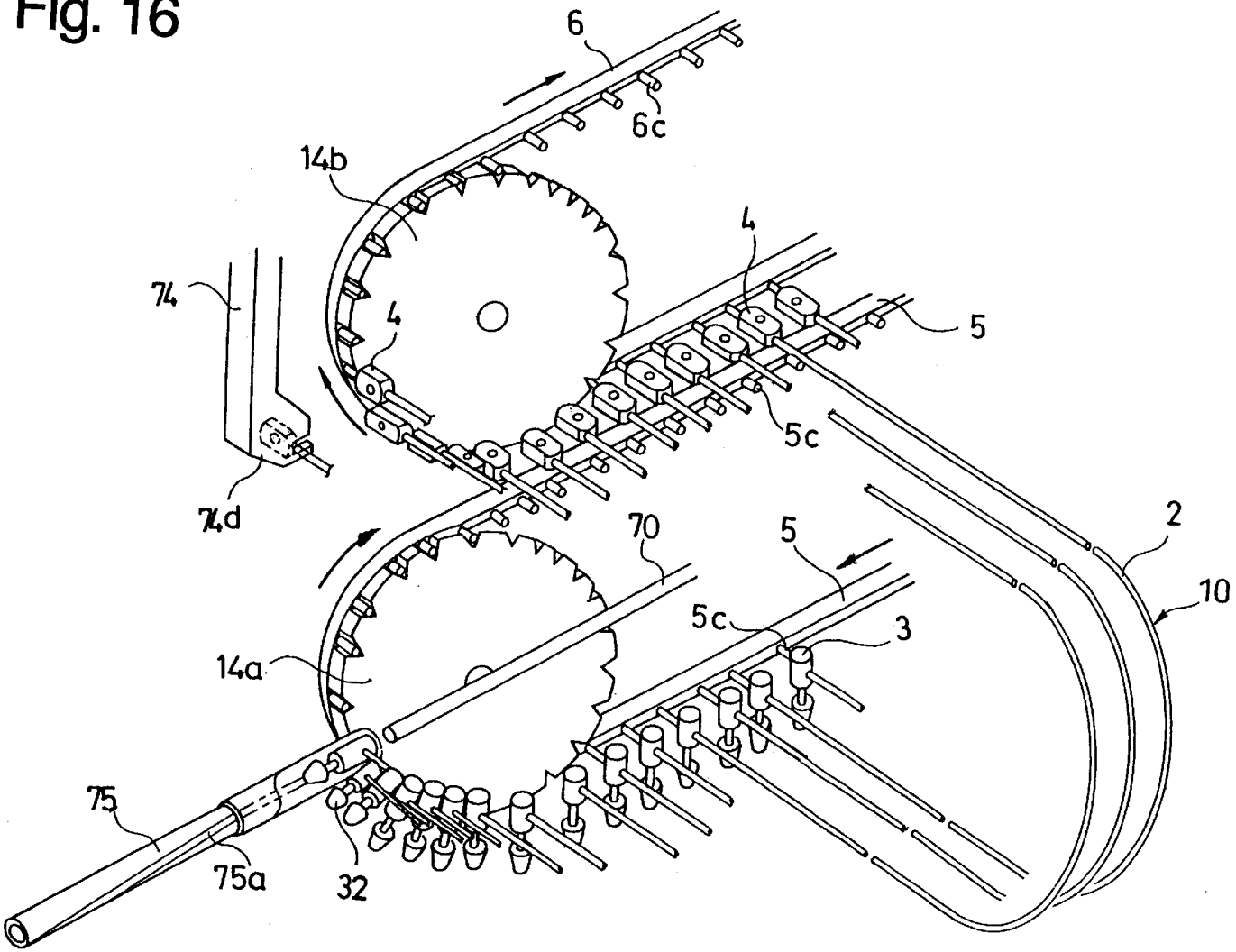
FIG. 16 is an explanatory diagram for explaining how the fastener assembly is carried in the attaching device. Detailed Description of the Preferred Embodiments.

FIG. 16 shows the state in which the fastener assembly 10 is fed in the attaching device.

First of all, the fastener assembly 10 is charged with its filament portions 2 being warped in the U-shape, so that the charged retaining projections 3 and the engaging holes (or the retaining holes) of the fitting portions 4 are respectively turned in the direction by 90 degrees from the extensions of the filament portions 2 so that they are arranged to vertically face each other. In other words, the axis of the retaining projections 3 and the axis of the engaging holes of the fitting members 4 are aligned with each other.

Moreover, the charged retaining projections 3 are carried forward by a wheel 14*a* and then turned in the direction (of their axes) from downward (the vertical direction) to forward (the horizontal direction) so that they are fed to the front of a rod 70, i.e., to the entrance of a hollow needle 75.

On the other hand, the charged fitting portions 4 are also carried forward by a wheel 14*b* and then turned in the direction (of the axes of their engaging holes 42) from downward (the vertical direction) to forward (the horizontal direction) so that they are fed to a grip position at which their head portions are to be gripped by a head supporting portion 74*d* of a head carrier arm 74. At this time, the filament portions 2 are proceeded while keeping their U-shaped sheet shape without any entanglement.

Then, the hollow needle 75 is inserted into the hole 7*a* of the price tag 7 and a button hole 9*a* of the commodity 9, and a lever 73 is squeezed. As the head carrier arm 74 is moved from a position indicated by double-dotted lines in FIG. 15 to a position indicated by solid lines in accordance with the motions of links 74*a* and 74*b*, the fitting portions 4 are gripped by the head supporting portion 74*d* of the head carrier arm 74 and are cut at their connection with the second joint member 6 by the not-shown blade. Then, the fitting portions 4 are carried to the front of the hollow needle 75 and held on standby. Since this carriage of the fitting portions 4 is performed by the link mechanism, the posture of the fitting portions 4, i.e., the direction of the engaging holes 42 of the fitting portions 4 is unchanged during the carriage so that it is kept in alignment with the direction of the retaining projections 3 to be driven into the engaging holes 42.

Simultaneously with this, each of the retaining projections 3 is driven by the rod 70, while being disconnected from the first joint member 5 by the not-shown blade, through the hollow needle 75 and forced out of the tip of the hollow needle 75 and is inserted to engage with the corresponding fitting portion 4 standing by ahead of the hollow needle 75 so that the corresponding filament portion 2 forms the loop R.

Then, the price tag 7 can be attached to the commodity 9 by the loop R of the filament portion 2.

As the fasteners 1 are consumed, the first and second joint members 5 and 6 having the fasteners 1 cut off are carried backward in the attaching device until they are discharged, respectively, from discharge passages 77*b* and *77a*.

Figure 3:
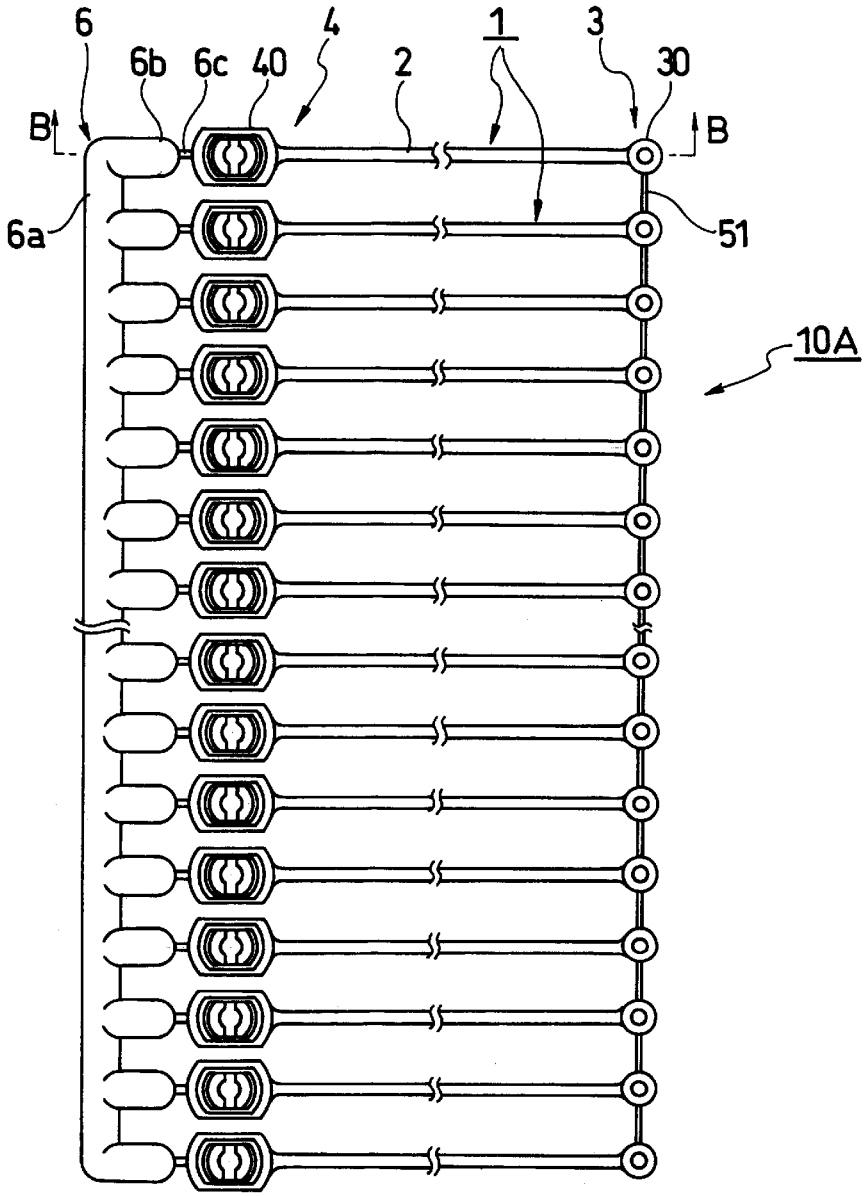
FIG. 3 is a top plan view showing a second embodiment of a fastener assembly according to the invention.
Figure 4:
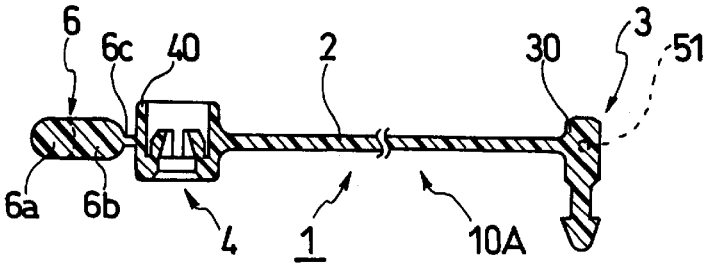
FIG. 4 is a section taken along line B—B of FIG. 3.

Next in the fastener assembly 10A of a second embodiment shown in FIGS. 3 and 4, the retaining projections 3 are jointed one another at their trunk portions 30 by first temporary joint portions 51 of a thin filament shape having a small section, and the fitting portions 4 are jointed at their frame portions 40 to the second joint member 6 having the second cutting portions 6*c* formed in the extending direction of the filament portions 2. This second joint member 6 is formed of: a second joint rod 6*a* having a relatively high rigidity; second projections 6*b* projecting in the shape of comb teeth from the second joint rods 6*a*; and second cutting portions 6*c* leading from the second projections 6*b* to the frame portions 40 of the fitting portions 4 and formed in the extending direction of the filament portions 2 while being reduced in their sections to be easily cut. The second joint member 6 thus formed is jointed to the fitting portions 4 on the side opposed to the filament portions 2.

Moreover, the fasteners 1 are jointed by the first temporary joint member 51 and the second joint member 6 so that they are arrayed in a sheet shape, and the axes of the retaining projections 3 and the axes of the engaging holes 42 of the fitting portions 4 are formed perpendicular to the arrayed plane of the fasteners 1.

Figure 5:
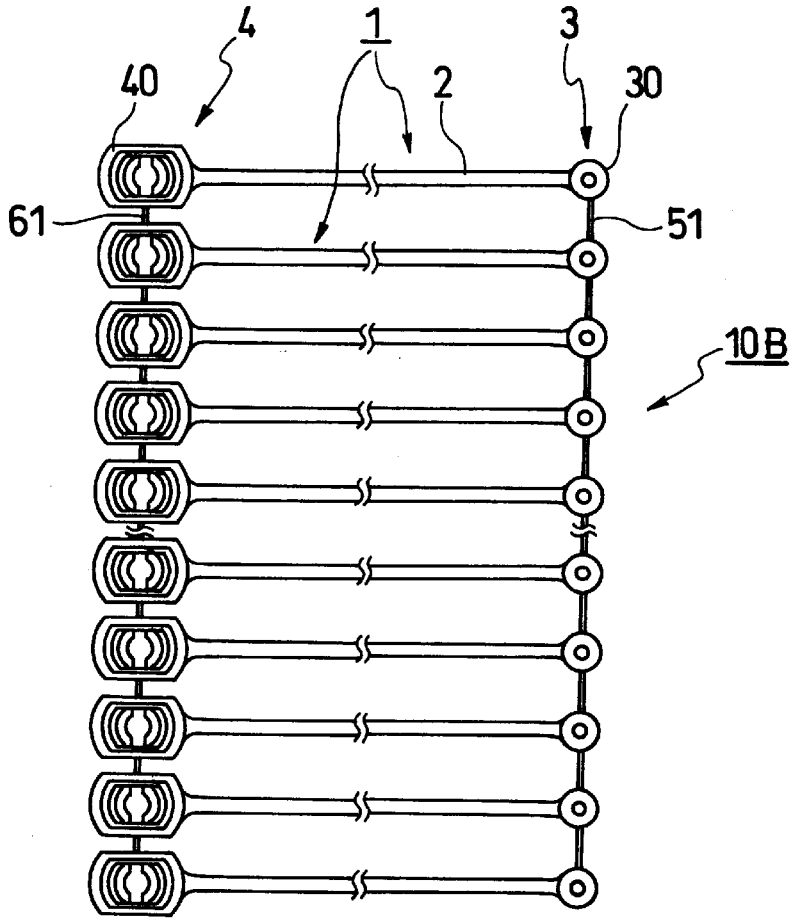
FIG. 5 is a top plan view showing a third embodiment of a fastener assembly according to the invention.
Figure 6:
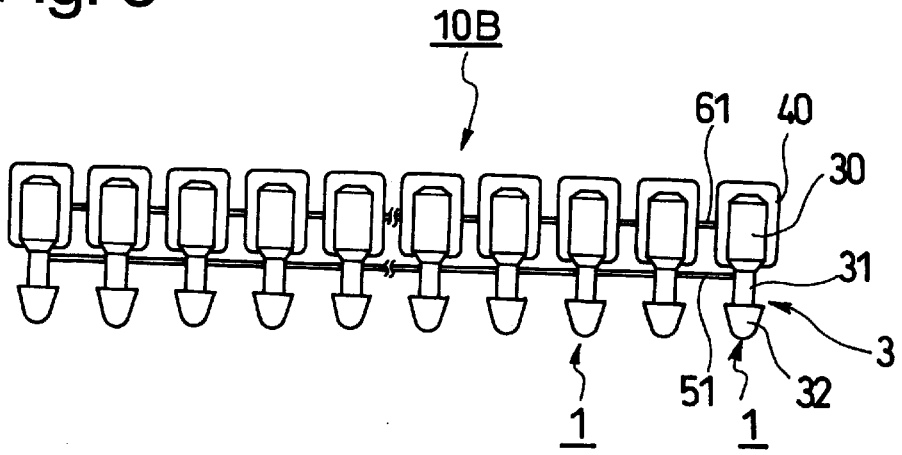
FIG. 6 is a righthand side elevation of FIG. 5.
Figure 7:
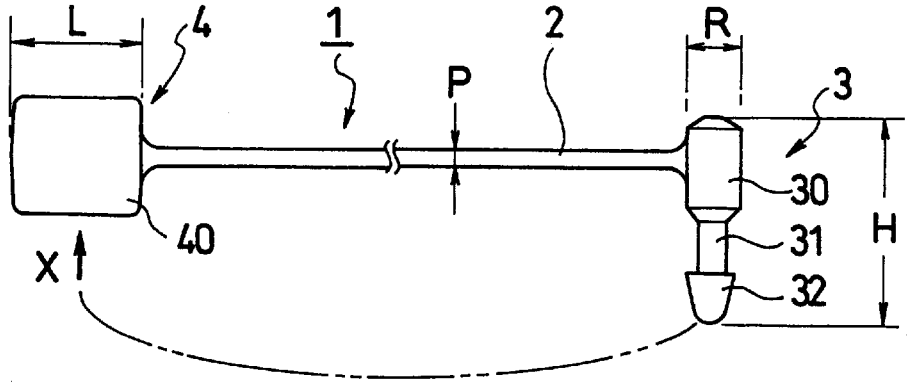
FIG. 7 is a front elevation showing a fastener simple composing the fastener assembly according to the invention.
Figure 8:
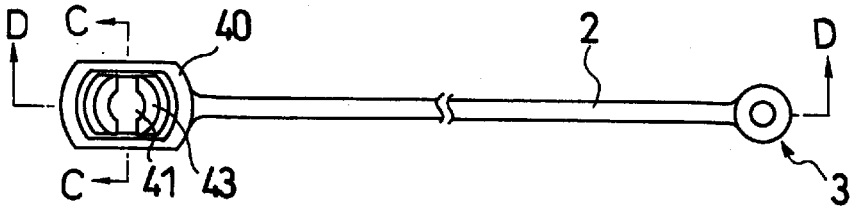
FIG. 8 is a top plan view of FIG. 7.
Figure 9:
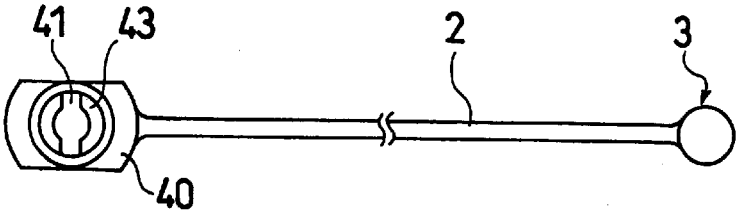
FIG. 9 is a bottom view of FIG. 7.
Figure 10:
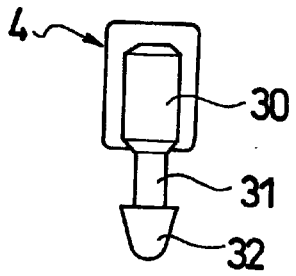
FIG. 10 is a righthand side elevation of FIG. 7.
Figure 11:
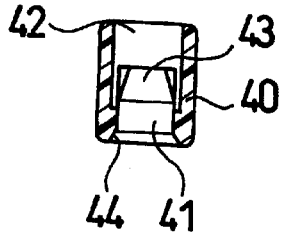
FIG. 11 is a section taken along line C—C of FIG. 8.

On the other hand, the fastener assembly 10B of a third embodiment shown in FIGS. 5 and 6 corresponds to the construction having filament portions 2 having a relatively small length and a relatively high rigidity. The trunk portions 30 of the retaining projections 3 are mutually jointed by the first temporary joint portions 51 having a small section, and the frame portions 40 of the fitting portions 4 are mutually jointed by the second temporary joint portions 61 having a small section.

Moreover, the fasteners 1 are jointed by the first temporary joint portion 51 and the second temporary joint portions 61 so that they are arrayed in a sheet shape, and the axes of the retaining projections 3 and the axes of the engaging holes 42 of the fitting portions 4 are formed perpendicular to the arrayed plane of the fasteners 1.

The sizes of the ordinary fastener assembly 10, 10A or 10B will be exemplified in the following. For the aforementioned sizes of the fasteners 1: the distances between centers of the fasteners 1 are 3.5 mm; the first and second joint rods 5*a* and 6*a* have a width of 2.0 mm and a thickness of 0.8 mm; the first and second projections 5*b* and 6*b* have a length of 1.5 mm, a width of 0.6 mm and a thickness of 0.8 mm; the first and second cutting portions 5*c* and 6*c* have an external diameter of 0.3 mm and a length of 0.5 mm; and the first and second temporary joint portions 51 and 61 have an external diameter of 0.3 mm. Moreover, twenty to two hundreds fasteners 1 make one fastener assembly 10.

When the individual fasteners 1 are to be disassembled in the attaching device, according to the fastener assembly 10, 10A or 10B thus constructed, they can be easily separated and fed individually by cutting them at their first and second cutting portions 5*c* and 6*c* or first and second temporary joint portions 51 and 61 having the reduced section by the blades belonging to the device.

On the other hand, the retaining projections 3 and the fitting portions 4 can be inserted into the charging portions 76*a* and 76*b* disposed vertically (above and below) in parallel in the righthand side face of the attaching device, so that this device can be easily charged with the retaining projections 3 and the fitting portions 4 with the sheet of the filament portions 2 being arranged in the U-shape outside of the attaching device. At the time feeding them to the front side of the attaching device, moreover, the filament portions can be carried without any entanglement while being in the U-shaped sheet. When the fastener 1 is jointed into the loop shape, still moreover, only the engaging sealers 1 are cut off so that the loops R of the independent fasteners 1 can be formed sequentially and continuously without any entanglement.

On the other hand, it means nothing but the axes of the retaining projections 3 and the axes of the engaging holes 42 of the fitting portions 4 are formed perpendicular to the filament portions 2, in view of the individual fasteners 1, that the axes of the retaining projections 3 and the axes of the engaging holes 42 of the fitting portions 4 are perpendicular to the arrayed plane of the fasteners 1. Moreover, the axes of the retaining projections 3 are perpendicular to the filament portions 2 so that the filament portions 2 raise no obstruction against the rear end faces of the retaining projections 3. As a result, the feed of the retaining projections 3 need not resort to the method of clamping them but can adopt a simple push method of pushing the rear end face of each of the retaining projections 3 with the push rod 70. In this method, moreover, the rear end face of the retaining projections 3 and the push area of the push rod 70 can be enlarged to push out the retaining projection 3 without fail. Still moreover, this retaining projection 3 can be easily inserted into the engaging hole 42 of the fitting portion 4 because the axis of the engaging hole 42 is perpendicular to the filament portion 2 so that it raises no obstruction against the insertion.

In the fastener assembly, on the other hand, the axes of the retaining projections 3 and the axes of the engaging holes 42 of the fitting portions 4 are in parallel with each other. Therefore, when the vertically arranged charging portions of the attaching device are charged with the retaining projections 3 and the fitting portions 4 with the sheet of the filament portions 2 being bent in the U-shape, the axes of the retaining projections 3 and the axes of the engaging holes 42 of the fitting portions 4 can be vertically aligned. This makes it possible to perform the operations of not only carrying, gripping, inserting and engaging the retaining projections 3 and the fitting portions 4 in the attaching device but also positioning the same efficiently and properly. Moreover, the posture of the fitting portion 4 and the retaining projection 3 can be controlled mechanically so simply and smoothly as to make it simple and accurate to carry and arrange the fitting portion 4 ahead of the hollow needle with its engaging hole 42 being directed toward the hollow needle and to proceed the retaining projection 3 in the hollow needle and bring it into engagement with the fitting portion 4.

On the other hand, the individual fasteners 1 can be manually disassembled by hands easily by cutting them at their first and second cutting portions 5*c* and 6*c* or first and second temporary joint portions 51 and 61 having the reduced sections by means of scissors or a cutter. Moreover, each fastener 1 is provided with two cutting portions at which it can be easily cut because they can be simultaneously confirmed from their top or bottom plan view.

In addition, the fastener assembly 10, 10A or 10B can be freed from being entangled during carriage or storage because their fasteners 1 are arrayed in the sheet shape.

Especially in the fastener assembly 10 of the first embodiment shown in FIGS. 1 and 2, the fastener assembly 10 is jointed with the first and second joint rods 5*a* and 6*a* having the relatively high rigidity so that the fasteners 1 can be prevented from being entangled by each other and from slipping out of the array. Moreover, the attaching device can be simply charged with the fastener assembly 10 having the fasteners arrayed, by making use of the rigidities of the first and second joint rods 5*a* and 6*a* at the two ends. Still moreover, these first and second joint rods 5*a* and 6*a* are provided outside of the two end portions of the fasteners 1 so that they can be easily confirmed from their top or bottom plan view to allow their easy grip.

Next, according to the fastener assembly 10A of the second embodiment shown in FIGS. 3 and 4, the fasteners 1 are jointed on their one-hand sides through the second joint rod 6*a* having the relatively high rigidity and on their other sides by the first temporary joint portions 51 having the relatively low rigidity. As compared with the fastener assembly 10 of FIGS. 1 and 2, therefore, the array of the side of the retaining projections 3 is easily disturbed but can be sufficiently held on only the side of the second joint rod 6*a* when the filament portions 2 are not so long. Moreover, the joints of the retaining projections 3 are made only by the first temporary joint portions 51 which are thin so that the material of a synthetic resin for the fastener assembly 10A can be spared. The easiness in gripping the second joint rod 6*a* is similar to that of the case of the fastener assembly 10 of the first embodiment.

According to the fastener assembly 10B of the third embodiment shown in FIGS. 5 and 6, moreover, the fasteners 1 are jointed through the first and second temporary joint portions 51 and 61 having the lower rigidity so that their array is easily disturbed. However, the filament portions 2 can be sufficiently held in the array when they are short. Moreover, the fasteners 1 are jointed exclusively by the first and second temporary joint portions 51 and 61 made thin, so that the material of a synthetic resin for the fastener assembly 10B can be drastically spared. Still moreover, the fastener assembly 10B is low in its two end rigidity so that it can be rolled up for no bulky transportation with its fasteners 1 being superposed. Still moreover, the fastener assembly 10B is flexible and bendable because it is jointed exclusively by the first and second temporary joint portions 51 and 61, so that it can also be used with an attaching device having a sharp curve at its portion for feeding the fasteners 1.

What is claimed is:

1. A fastener assembly to be loaded on and used by an attaching device for attaching fasteners to merchandise, comprising: a plurality of fasteners each including a retaining projection, a fitting portion formed with an engaging hole in which said retaining projection can be engaged, and a flexible filament portion having a smaller diameter than said retaining projection and said fitting portion and arranged between said retaining projection and said fitting portion, said filament portion being connected at a first end to a side of said retaining Projection and at a second end to a side of said fitting portion, said engaging hole being formed inside thereof with a pair of retaining members with which said retaining projection engages, each of said retaining members being in the form of a cantilever and having an elasticity and a substantially arc-shaped engaging face; a first joint member connecting with the retaining projections of said fasteners through a first cutting portion having a reduced sectional area; and a second joint member connecting with said fitting portions through a second cutting portion having a reduced sectional area, wherein said plurality of fasteners are fixed to and securely supported by said first joint member and said second joint member in an array in a plane, said plane including said plurality of fasteners, said first joint member, said first cutting portion, said second joint member and said second cutting portion; wherein said retaining projection and said engaging hole of said fitting portion have their respective longitudinal axes at a right angle relative to the plane in which the plurality of fasteners are in an array; wherein the retaining projection is guided together with the first joint member from a charging portion of the attaching device to an entrance to a hollow needle of the attaching device and the filling portion is guided together with the second joint member from a charging portion to a grip and carrying position of the attaching device and wherein the filament portion is projected in a U-letter shape outwardly on a side of the attaching device.

2. A fastener assembly according to claim 1, wherein said first joint member and said second joint member have a flattened substantially rectangular cross-section with a larger side in a longitudinal direction of said fasteners.

* * * * *